United States Patent [19]

Winchell

[11] 4,005,739

[45] Feb. 1, 1977

[54] SUPPLEMENTAL MEDICATION INDICATION CAP FOR SOLUTION CONTAINERS AND THE LIKE

[75] Inventor: David Allen Winchell, Twin Lakes, Wis.

[73] Assignee: Baxter Travenol Laboratories, Inc., Deerfield, Ill.

[22] Filed: Oct. 20, 1975

[21] Appl. No.: 624,195

[52] U.S. Cl. ..... 150/8

[51] Int. Cl.[2] ..... B65D 33/16

[58] Field of Search .... 150/8; 128/214 D, DIG. 24; 215/247, 248, 317, 277

[56] References Cited

UNITED STATES PATENTS

| | | | |
|---|---|---|---|
| 1,316,231 | 9/1919 | Hammer | 215/317 |
| 3,066,821 | 12/1962 | Conklin | 215/277 X |
| 3,499,568 | 3/1970 | Riera | 215/247 X |
| 3,746,001 | 7/1973 | Ralston | 150/8 X |
| 3,810,503 | 5/1974 | Lewis | 150/8 |

FOREIGN PATENTS OR APPLICATIONS

| | | | |
|---|---|---|---|
| 54,553 | 5/1943 | Netherlands | 215/317 |

*Primary Examiner*—Donald F. Norton
*Attorney, Agent, or Firm*—Garrettson Ellis; Paul C. Flattery

[57] ABSTRACT

A supplemental medication indication cap is provided for solution containers having a tubular access port. The cap comprises a tubular member adapted to fit about the tubular access port. In one aspect of the invention, the tubular member defines, at one end thereof, several gripper arms adapted for irreversibly engaging the access port, whereby the non-destructive removal of the cap, once it is installed on the access port, is prevented. In another aspect of this invention, the tubular member of the indication cap is an open tube for receiving a needle for further administration of supplemental medication. If no further medication is to be provided, a plug member may be inserted in the tubular member to block access to the tubular access port.

9 Claims, 3 Drawing Figures

10
14
12
20
18
29
22
20
16
28
26
24
30

10
32
12
28
26
29
24
42
22
30
34

26
28
44
24
42
36
40
38
34
30

SUPPLEMENTAL MEDICATION INDICATION CAP FOR SOLUTION CONTAINERS AND THE LIKE

BACKGROUND OF THE INVENTION

In the administration of medical solutions, and particularly parenteral solutions to patients, sterile containers are used, such as the VIAFLEX containers sold by Travenol Laboratories, Inc. of Deerfield, Illinois. This particular container is a collapsible plastic bag defining a pair of tubular sterile access ports. A needle or a spike can be placed through one of the access ports in order to obtain the contents of the container. Generally, the second access port is provided for the purpose of adding supplemental medication by means of a hypodermic needle. A latex, needle-pierceable stopper is provided over the end of the medication port, to reseal the port after supplemental medication has been administered, and the needle withdrawn.

It is a well known fact, and a continuing hospital problem, that one must be very careful in how supplemental medication is administered to a solution container. For example, although potassium salts are regularly administered as a supplemental medication, the administration of excessive concentrations of potassium salts can cause heart failure. Furthermore, certain combinations of supplemental medications are incompatible and dangerous to the patient.

Accordingly, it becomes a matter of absolute necessity to keep strict track of what has been added to a medication solution container. The careless addition by an overworked nurse of an extra aliquot of potassium chloride supplemental medication, or the accidental addition of two incompatible medications, could result in the injury or death of a patient.

DESCRIPTION OF THE INVENTION

In accordance with this invention, a supplemental medication indication cap for solution containers with a tubular access port is provided. A tubular member, adapted to fit about the tubular access port, defines one end thereof which carries means for irreversibly engaging the access port. Typically, the last named means may comprise a plurality of barbed gripper arms. As specifically shown below, the gripper arms engage the tubular access port in such a manner as to prevent the nondestructive removal of the cap, once it is installed on the access port.

For example, the access port may include an elastic, needle-pierceable stopper or injection site of conventional design. The gripper arms, when the cap is installed on the access port, may engage the stopper so that the forced removal of the cap from the access port also caused the removal of the stopper. This results in a loss of sterility in the tubular access port, and thus either prevents its use, or in some circumstances forces the operator to replace the container with a new container. Accordingly, the users of this system are strongly deterred from attempting to shortcut the safety procedures provided by the cap of this invention.

Typically, the tubular member of the cap of this invention is open at both ends. Thus, the installation of the tubular member of this invention on an access port can simply serve as an indicator that supplemental medication has already been added, while permitting the injection of further supplemental medication. This greatly reduces the possibility of the accidental or heedless addition of a second unit of supplemental medication, without the physician or nurse giving consideration to what has been previously added to the container.

If, however, in the judgement of the user, no further supplemental medication should be added to a given container, a plug member is provided for obstructing the bore of the open tubular cap of this invention. Accordingly, the further addition of supplemental medication is physically prevented.

Figures 1, 2, 3:
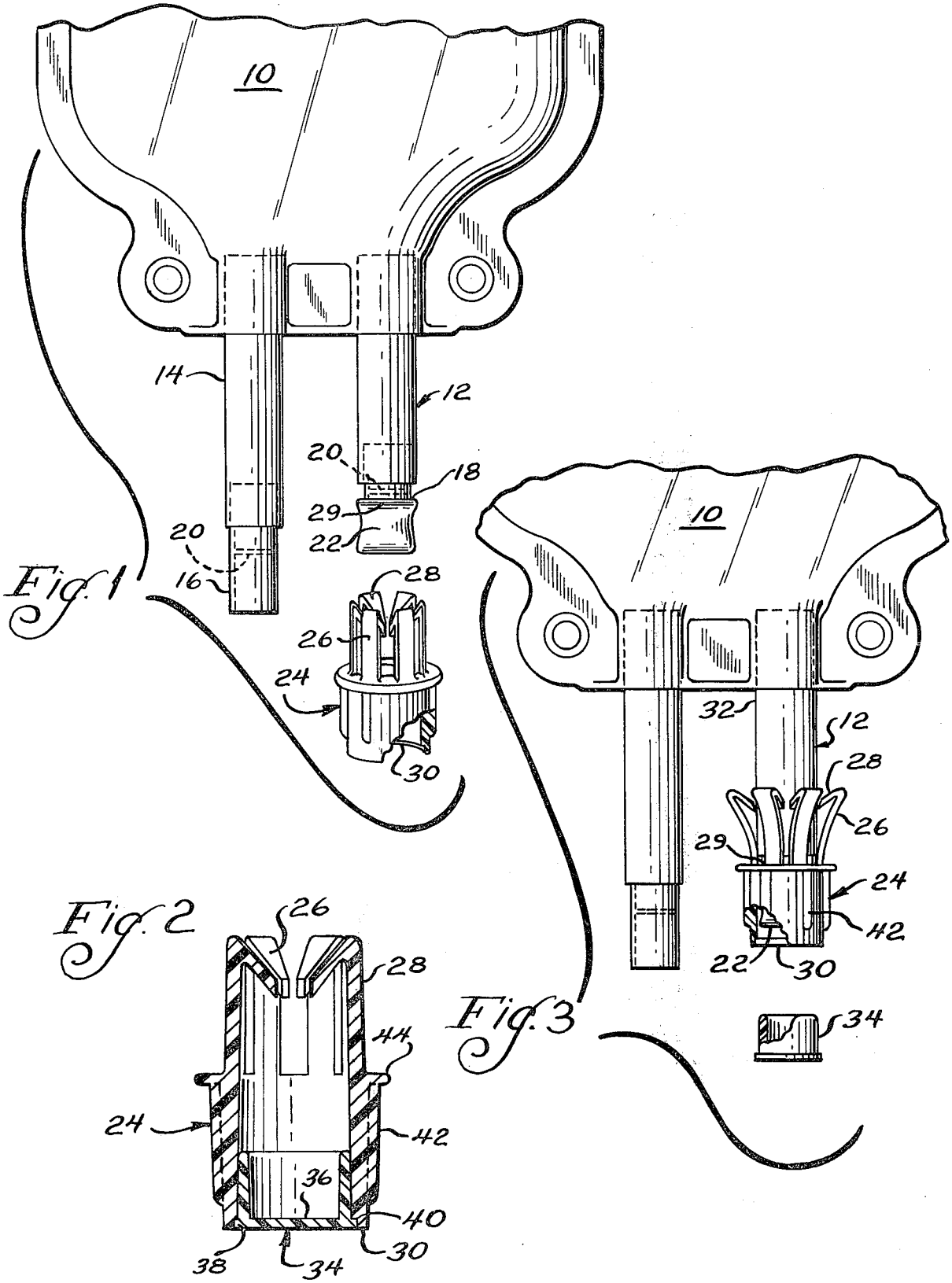
FIG. 1 is a perspective view, with portions broken away, of the supplemental medication indication cap of this invention, shown prior to installation on a tubular access port of a conventional parenteral solution container.
FIG. 2 is a vertical sectional view of the supplemental medication indication cap of this invention, with a separate plug member shown retained therein.
FIG. 3 is a fragmentary plan view of the supplemental medication indication cap of this invention, shown installed on a tubular access port of the sterile solution container of FIG. 1, with the plug member shown prior to installation.

Referring to the drawings, a fragment of sterile solution container 10 is shown as a heat-sealed, plastic bag similar to the VIAFLEX containers described above. Container 10 defines a pair of flexible plastic tubular access ports 12, 14. Each of the access ports 12, 14 carries a rigid tube 16, 18, having a bore closed off by a diaphragm 20, for sterile sealing of container 10.

Accordingly, for gaining access to container 10 with a hollow spike in the conventional manner, the spike is inserted into the tube 16, to rupture diaphragm 20. Thereafter, the contents of container 10 will flow out through the spike, which is generally part of a sterile parenteral solution administration set. However, it is also contemplated that the invention of this application can be used for blood containers as well as sterile solution containers, or any other desired contents.

Rigid tube 18 carries a conventional latex resealable injection site 22 about its outer periphery, for the addition to container 10 of supplemental medication in a sterile manner by a syringe needle.

In accordance with this invention, a supplemental medication indication cap 24 is provided. Cap 24 is adapted to fit about tubular access port 12, and defines at one end thereof a number of gripper arms 26, adapted for irreversibly engaging the access port, particularly by means of hook members 28 on arms 26. As cap 24 is fitted over latex injection site 22 and about tube 12, arms 26 are biased outwardly, as shown in FIG. 3, to exert an inward bias pressure of hooks 28 against tube 12.

As a result of this, once the configuration of FIG. 3 has been achieved, it becomes extremely difficult or impossible to remove cap 24, without hooks 28 or arms 26 engaging the inner edge 29 of the injection site 22. If one continues to attempt to remove cap 24, injection site 22 will be removed along with it off of rigid tube 18. This results in a break of sterility about the outlet of rigid tube 18, rendering access port 12 unusable. If the diaphargm 20 inside of tube 18 has been ruptured, the liquid contents of container 10 will spill out.

As a result of these undesirable possibilities, the users are strongly deterred from attempting to remove cap 24 after it has been installed.

Accordingly, the installation of cap 24 by a simple upward push about injection site 22 and rigid tube 18, serves as an indication that supplemental medication has been added to container 10 through port 12.

Cap 24 defines an open outer end 30, so that supplemental medication can be added through cap 24 and injection site 22 by a syringe needle, if a second medication is to be added to container 10 at some time after the installation of cap 24. This can be most conveniently accomplished by proportioning the length of access port 12 to permit one to slide cap 24 upwardly toward the upper end 32 of access port 12, to expose injection site 22 through open end 30. Thereafter, injection site 22 can be swabbed with alcohol or another disinfectant, and a sterile addition of medicament may be added to container 10 through the injection site. Thereafter, cap 24 can be brought down again to the position shown in FIG. 3, to protect injection site 22.

If at any time it is concluded that no further supplemental medication should be added to container 10, plug 34, comprising a hollow cup in the embodiment shown, can be placed into open end 30 with a friction fit, as shown in FIG. 2, to close cap 24 and to physically block access to latex injection site 22.

As shown in FIG. 2, cap 34 defines a transverse wall 36, which includes a circumferential flange 38. Flange 38 fits into a counterbore portion 40 at end 30 of the cap. As a result of this, plug 34, once installed in a cap 24 which is mounted on a tubular access port, is extremely difficult to remove for unauthorized injections through site 22.

Cap 24 defines knurls 42 and flange 44, to facilitate gripping and manipulation. Both cap 24 and plug 34 can be made of molded plastic.

The above has been offered for illustrative purposes only, and is not for the purpose of limiting the scope of this invention, which is as defined in the claims below.

That which is claimed is:

1. A supplemental medication indication cap in which said cap is installed on a solution container tubular access port, said access port carrying at its outer end an elastic, needle-piercable injection site, said cap being positioned to fit about said tubular access port, said cap defining at one end thereof a plurality of gripper arms, said gripper arms being positioned to engage said injection site upon attempted removal of said cap from the access port, whereby the forced removal of the cap from the access port also causes removal of said injection site.

2. The supplemental medication indication cap of claim 1 in which said cap comprises an open tube for receiving a needle, for the further administration of supplemental medication.

3. The supplemental medication indication cap of claim 2 in which said cap carries, at its outer end opposite to said gripper arms, a plug member firmly retained therein to prevent the further administration of supplemental medication.

4. A supplemental indication cap in which said cap is installed on a solution container tubular access port, said access port carrying at its outer end an elastic, needle-piercable injection site, said cap being adapted to fit about said tubular access port, means carried by said cap for engagement with an inner end of said injection site upon attempted removal of said cap from said access port, whereby the forced removal of said cap from the access port also causes the removal of said injection site, said cap defining an open tube for receiving a needle for injection through said site for further administration of supplemental medication.

5. The supplemental medication indication cap of claim 4 in which said cap carries, opposite its outer end, as defined with respect to its attachment to said solution container, a plug member fitting tightly in said open tube and blocking communication through said cap, to prevent further administration of supplemental medication therethrough.

6. The supplemental medication cap of claim 5 in which said engagement means comprises a plurality of gripper arms.

7. In a solution container having a tubular access port, said access port carrying at its outer end an elastic, needle-piercable injection site; a supplemental medication indication cap carried by said access port, said cap carrying gripper means adapted for engaging said injection site adjacent an inner end thereof upon attempted removal of said cap from the access port, whereby forced removal of said cap from the access port also causes removal of said injection site.

8. The solution container of claim 7 in which said cap is adapted and positioned to prevent injection through said injection site.

9. The solution container of claim 8 in which said gripper means comprises a plurality of gripper arms carried by said cap, said gripper arms being positioned to engage said injection site upon attempted removal of said cap from the access port, whereby the forced removal of the cap from the access port also causes removal of said injection site.

* * * * *